United States Patent [19]

Riggsby

[11] Patent Number: 4,735,471

[45] Date of Patent: Apr. 5, 1988

[54] ADJUSTABLE HEIGHT BOOKCASE

[76] Inventor: Caryl W. Riggsby, 316 Crystal St., Cary, Ill. 60013

[21] Appl. No.: 13,365

[22] Filed: Feb. 11, 1987

[51] Int. Cl.[4] ..... A47B 57/06; A47B 87/00

[52] U.S. Cl. ..... 312/312; 312/306; 211/187

[58] Field of Search ..... 312/312, 306, 196, 268, 312/272; 108/106, 144; 211/187, 203

[56] References Cited

U.S. PATENT DOCUMENTS

| | | | |
|---|---|---|---|
| 360,020 | 3/1887 | Iske | 312/312 |
| 1,099,521 | 6/1914 | Sprung | 312/196 |
| 1,166,988 | 1/1916 | Hinkson | 312/312 |
| 2,019,455 | 10/1935 | Lehman | 312/312 |
| 2,931,685 | 4/1960 | Butler | 312/196 |
| 3,542,446 | 11/1970 | Joyce | 312/312 |
| 4,088,380 | 5/1978 | Watts | 312/306 |
| 4,204,480 | 5/1980 | Hanna | 211/187 |
| 4,292,903 | 10/1981 | Hockema | 312/312 |
| 4,322,118 | 3/1982 | Shugart | 312/306 |

FOREIGN PATENT DOCUMENTS

| | | | |
|---|---|---|---|
| 1011034 | 6/1952 | France | 312/312 |

*Primary Examiner*—Victor N. Sakran

*Attorney, Agent, or Firm*—Michael J. Femal

[57] ABSTRACT

A library type bookcase having a base with a generally U-shaped slot thereon for slideably receiving an upper shelving section therein to adjust the height of the bookcase to meet the aesthetics of the owner or the height of the room that it is placed in. The same pins which support the shelves between the sides of the shelving section also serve to fixedly position the shelving section with respect to the base.

9 Claims, 1 Drawing Sheet

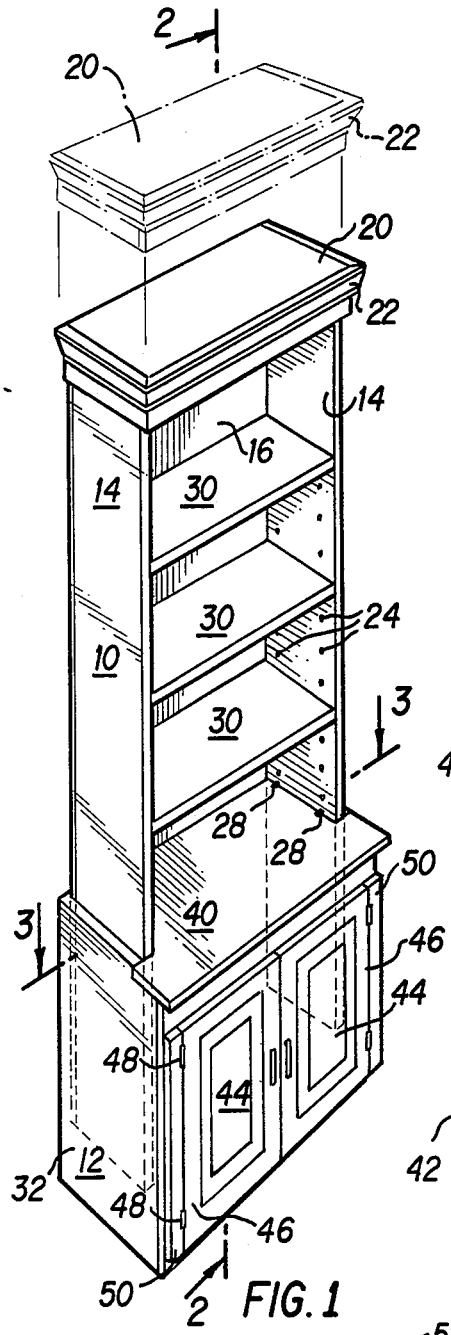
FIG. 1
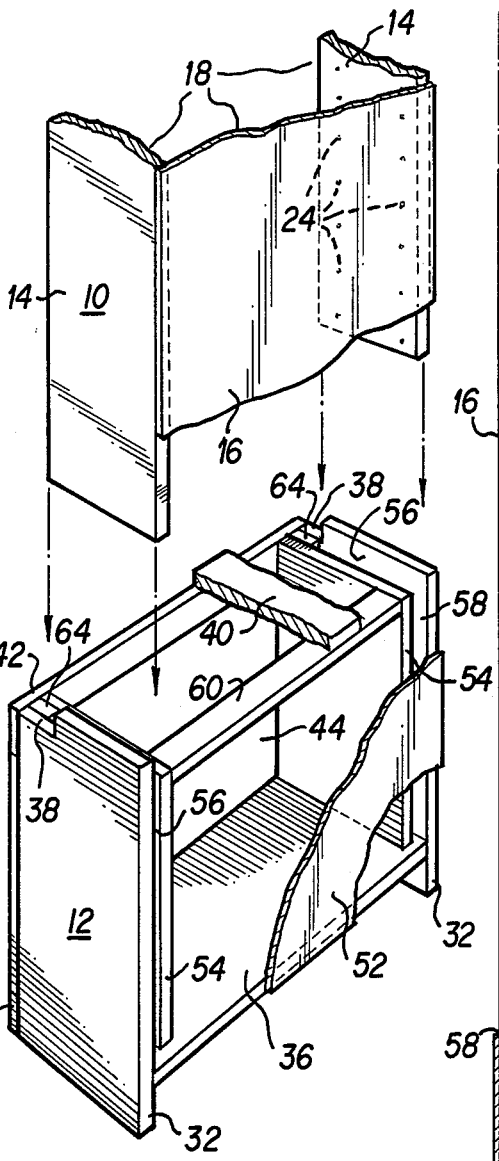
FIG. 4
FIG. 2
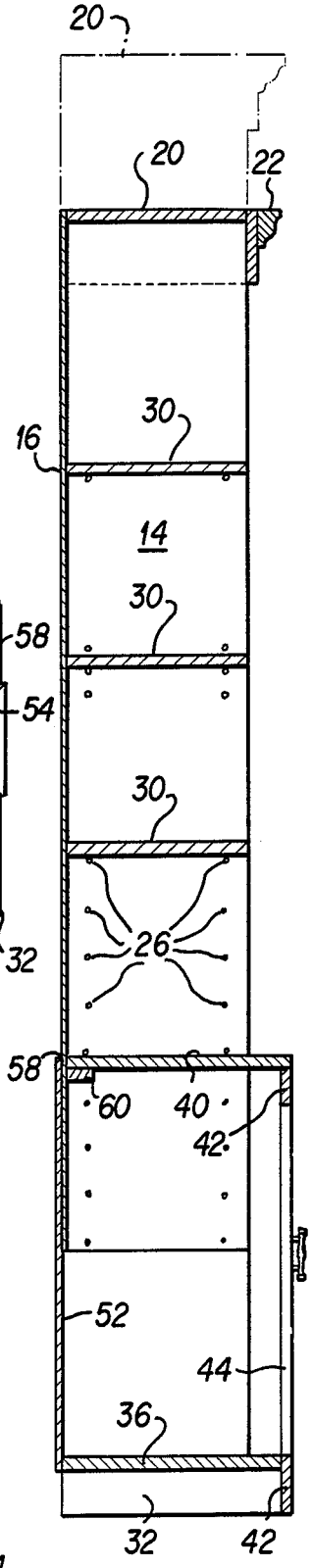
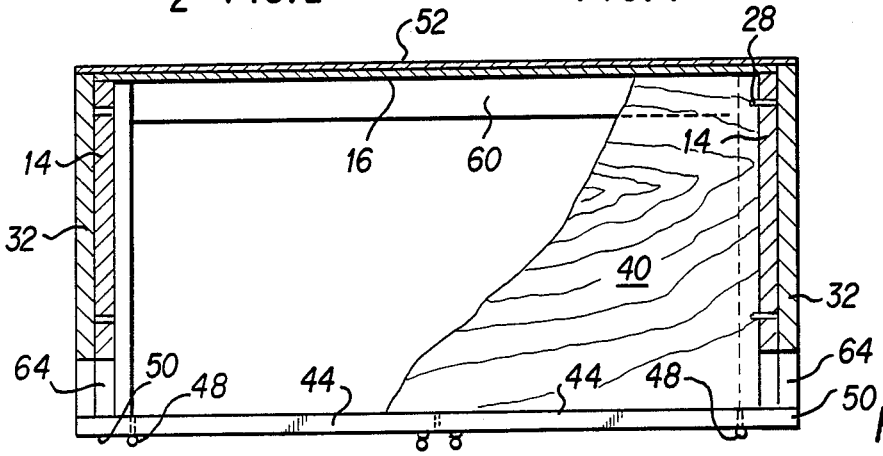
FIG. 3

ADJUSTABLE HEIGHT BOOKCASE

BACKGROUND OF THE INVENTION

This invention relates to an adjustable height bookcase, and particularly to a bookcase assembly including a slideably connected shelving top section received within a stationary base section that provides for the vertical adjustment of the shelving top section with respect to the base section.

It is common practice in carpentry to assemble custom made bookcases in a particular room within a home or office in which the height of the bookcase is measured and built to meet the overall height of the room. Such bookcases are considered pieces of furniture by their owners and when they move to a different home or office, they typically take these type of bookcases with them. However, the new home or office room might have a different height for the ceiling. This caused bookcases which fit perfectly in the original room that they were built for to now to be high or low for the new ceiling. In the case of being to high, the owner could not use the custom bookcase and would incur additional expense of having a new one built. In the case of being to low, the owner was faced with a bookcase that was aesthetically out of place.

Another problem that faced owners of custom bookcase is the situation where the existing bookcase needed just one or more additional shelves to hold the books that the owner needed in an office or room in the home. The only solution was to have a new bookcase built even if there was additional height between the top of the bookcase and the ceiling of the room.

The present invention solves the problem of prior art custom bookcases by providing a simple but unique height adjustment ability built into the bookcase structure so that the owner can easily adjust the height and number of shelves that the bookcase contains. Preferably, the top shelving section is slideably received within the base section and can be drawn upwardly or downwardly with just the removal of the shelving pins that hold the shelves in place.

SUMMARY OF THE INVENTION

The invention resides in the combination of a stationary base section or cabinet which slideably receives the shelving section above. A unit of this construction is often considered a library unit that acts as a very useful piece of furniture. Library units are used singly, in pairs, or line an entire wall. This particular bookcase offers shelving above for books and curios and storage cabinets below. Because the upper shelving section is slideably received in the lower base section, the bookcase or library unit can easily be adapted to the height of the room or the number of bookshelves desired. To adjust the height of the bookcase, the shelving pins on the inside of the vertical sides of the top shelving section are withdrawn and the top section is either raised or lowered to a predetermined height before the shelving pins are reinserted and the shelves replaced therein.

This unique manner of adjusting the height of the bookcase permits the owner to still have a handsome piece of custom furniture without unsightly attachments thereto to hold the top shelving section in place which might ruin the aesthetics of furniture.

BRIEF DESCRIPTION OF THE DRAWINGS

FIG. 1 is a perspective view in vertical elevation with the top of shelving section broken away and in section, of a bookcase made in accordance with the present invention;

FIG. 2 is a side elevation taken along lines 2—3 of FIG. 1;

FIG. 3 is a downward section of a base section of the bookcase taken along section lines 3—3 of FIG. 1; and FIG. 4 is a rear view of the bookcase of FIG. 1 broken away in the top shelving section and the base section.

DESCRIPTION OF THE INVENTION

Referring to FIG. 1, the bookcase or library wall unit of the present invention includes a top shelving section 10 and a lower base or cabinet section 12. The top shelving section 10 includes a pair of opposing vertical sides 14 rigidly spaced apart by a back panel 16 affixed to the same ends of sides 14 by any suitable means such as glue, nails or the like to form a generally U-shaped shelving housing 18. The housing 18 further includes a top 20 attached to the top end of the back panel 16 and vertical sides 14. A decorative moulding 22 extends around the periphery of the top 20 which is generally in a rectangular shape to hide the joint between 20 and the vertical sides 14 and back panel 16.

The vertical sides 14 have a predetermined number of holes 24 aligned generally in two spaced apart vertical rows 26 on the sides facing one another. A pair of pins 28 are placed in the same horizontal line in each row on opposing sides of the vertical sides 14 to mount a shelf 30 thereon. The shelves 30 are in a generally rectangular shape and fit with sufficient clearance between their ends and the vertical sides 14 to span the width between the vertical sides 14 and act as a book shelf. The pins 28 serve a dual purpose beside just supporting the book shelves 30, the pins 28 also are placed within the holes 24 without a shelf 30 on each vertical side 14 so that the four pins 28 so situated adjust the height of the shelving section 10 as to be described in greater detail later.

The lower base or cabinet section 12 includes a pair of opposing sides 32 which are a mirrored image of each other. These generally rectangular shaped sides 32 serve as the finished outside panels of the cabinets of the bookcase unit. Turning now to FIG. 4, the panels 32 are spaced apart from one another a predetermined distance and form the base support of the bookcase by having one of their ends resting on the floor of a room. Located slightly above the bottom ends of the panels 32 are a pair of cleats 34 mounted opposite one another and parallel thereto on the inside surface of each panel to form a support for a base self 36 spanning the distance between the side panels 32 of the cabinet. The top end of each panel 32 in the front includes a notch 38 for receiving a top panel 40 that acts as the top curface of the cabinet 12. A pair of finished rails 42 are mounted on the front ends of each panel 32 in a spaced apart relationship to one another and parallel to act as support members for the cabinet base 12. One rail 42 is mounted at the top and the other rail 42 is mounted at the bottom and both overlap the front end of the panels 32 to define a generally rectangular opening into the cabinet interior via a pair of cabinet doors 44 which meet at the center on the front of the cabinet 12 and swing open from the center. The doors 44 each have a door stile 46 attached by a pair of butt hinges 48 to a pair of partition stiles 50 mounted on either side of the front of the cabinet 12 and spanning the distance between the top and bottom rails 42.

A back panel 52 in a generally rectangular shape encloses the back of the cabinet 12 and is mounted to the back ends of the panels 32 and shelf 36. As seen in FIG. 4, a second pair of generally rectangular panels 54 of a smaller dimension form the sides of the interior of the cabinet space for storing objects. These panels 54 are each spaced a predetermined distance from the closely adjacent side panels 32 to form a pair of slots 56. The bottom ends of each panel 54 rest on top of the base shelf 36 and each panel 54 is spaced the same distance from the back panel 52 to form a rear slot 58 with a horizontal support rail 60 mounted between the two panels 54 at the rear top end thereof. The support rail 60 forms the rear support for the top panel 40. The top ends of end panel 54 are approximately the thickness of panel 40 below the top of each panel 32. As a result, top panel 40 mounts over the top ends of panels 54 and overlaps the notches 38 on each front top end of panels 32 to form a level surface for the top of the cabinet 12 and to provide a finished look. The base has a U-shaped slot that coincides with the dimensions of the U-shaped housing 18 of the shelving section 10 so that the U-shaped slot in the cabinet 12 slideably receives the U-shaped housing of the top shelving section 10. The relationship of the top section 10 and the cabinet 12 is clearly shown in FIG. 4 and the arrows therein show that the top U-shaped structure of the shelving section 10 fits within the U-shaped slot of the cabinet 12.

Referring now to FIG. 2, the adjustment of the shelving section 10 is shown. The housing 18 of the top section 10 is raixsed or lowered depending on the overall desired height of the bookcase. The pins 28 are removed from the vertical row of holes 24 on each side 14 and then the housing 18 can be raised or lowered to the desirable height by reinserting the pins 28 in the holes 24 on each side 14 of the housing 18. The typical height may range from six to eight feet depending on which row of holes the pins 28 are placed in. However, the overall length of the housing 18 and the height of the cabinet could be varied to reach any desired overall height for the bookcase as a unit. As seen in FIG. 2, the shelving section 10 had been raised to a height 62 before the pins 28 were removed from the holes 24 and then lowered to the current height and the pins 28 reinserted to maintain the predetermined height.

Turning now to FIG. 4 the base section 12 is shown with a pair of spacer blocks 64 located vertically between the front ends of the panels 32 and 54. These spacer blocks 64 served as further support between the panels 32 and 54 and also assure that the slots 56 and 58 forming the U-shaped slot for the housing maintains its tolerance. The pins 28 can be seen resting on the top surface of the panel 40 and inserted into holes 24 for maintaining the height of the shelving section 10 as shown in FIGS. 1 and 2.

Although an embodiment of the invention has been illustrated in the accompanying drawings and described in foregoing detailed description, it will be understood that the invention is not limited to the embodiment disclosed, but is capable of numerous rearrangements, modifications and substitution of structural members to form an adjustable bookcase unit without departing from the scope of the invention.

I claim:

1. A bookcase, comprising:

a base having a pair of spaced apart and opposing sides, a top panel attached to the top end of said sides, a back panel attached to the rear end of said sides and a front panel attached to the rear end of said sides and a front panel attached to the front end of said sides, said top panel having a slot therethrough of a predetermined width and length extending vertically downwardly a predetermined distance adjacent to the interior length of each side and back panel to form a generally U-shaped, vertical support slot in said base;

a vertical shelving section for storing books, curios and the like having a pair of generally rectangular and spaced apart, opposing sides, a back panel attached to the rear ends of said sides to form a generally U-shaped housing having a thickness and length on its edge generally coninciding with the dimensions of said support slot on the base so that the housing is slideably received and supported within said slot in order to raise or lower said housing to adjust the overall height of the bookcase; and means connected in an interferingly relationship between the base and vertical shelving section for positioning the shelving section at a predetermined height above the top panel of said base, wherein said positioning means includes at least one shelf support pin, a pair of vertical rows of holes spaced apart from one another located on each interior surface of the sides for removably receiving said pin, said pin extending outwardly form the hole at one end to overlap the surface of the top panel preventing the shelving section from sliding further down into the slot in the base when the pin is inserted in one of said holes.

2. A bookcase of claim 1, wherein a pair of holes on each interior side are on the same horizontal plane so that four pins, two on each side of the shelving section provide a stable four point support to maintain the shelving section in a predetermined height with respect to said base.

3. A bookcase of claim 2, wherein the base further includes a second pair of spaced apart sides defining the interior space of said base, a base shelf mounted between the first pair of opposing sides at the bottom thereof with the second pair of opposing sides mounted on top thereof and spaced from the first to form said the legs of the U-shaped slot and to form a cabinet enclosure with the base, front and second pair of sides of said base section.

4. A bookcase of claim 3, wherein the rear of said second sides of the base are spaced a predetermined distance from the back panel to form the bottom leg of the U-shaped slot.

5. A bookcase of claim 4, wherein the base includes a support rail connecting the rear uppermost section of the second sides to provide support for the top panel which overlaps said rear support rail.

6. A bookcase of claim 5, wherein the base includes a pair of doors hingedly affixed to the front of said cabinet so that the user can access the interior space of said cabinet.

7. A bookcase, comprising:

a lower cabinet including a pair of spaced apart opposing sides, a generally rectangular top panel mounted on the top end of said sides, a back panel attached to the rear of said sides and spaced a predetermined distance from the rear edge of said top panel to form a rear slot, a front, a front panel attached to the front ends of said sides, a base shelf mounted between said sides at the bottom portion thereof, and a second pair of sides mounted on top of the base shelf between the first sides and closely adjacent and parallel to each first side to form slots therebetween that join the back slot, said back and side slots forming a single, generally U-shaped slot extending from the top panel to the base shelf;

an upper housing for the book shelves including a pair of spaced apart, opposing vertical sides, a back panel onnected to the rear end of each side forming a generally U-shaped configuration coinciding with the dimensions of the U-shaped slot on the base so that the upper housing is slideably received within said base slot and supported therein, said sliding relationship between the upper housing and base provides for adjusting the overall height of the bookcase;

means removably received within the opposing sides of said housing and engaging the surface of the top panel on said base for fixedly positioning the housing with respect to said base to adjust the overall height of the bookcase.

8. A bookcase of claim 7, wherein said housing sides each have two spaced apart parallel rows of holes extending vertically thereon and said positioning means includes pins which are inserted within said holes on the same horizontal plane on each side to support a shelf or to position the housing above said base.

9. A bookcase of claim 8, wherein said base further includes a rear support rail connected between the uppermost rear end of said second sides to provide support for the top panel and further define the bottom leg of said U-shaped slot.

* * * * *